United States Patent [19]

Babendererde et al.

[11] Patent Number: 4,621,947

[45] Date of Patent: Nov. 11, 1986

[54] METHOD OF AND APPARATUS FOR THE LINING OF A TUNNEL WITH CONCRETE

[75] Inventors: Siegmund Babendererde, Bad Vilbel; Gunnar Lah, Erzhausen, both of Fed. Rep. of Germany

[73] Assignee: Hochtief Aktiengesellschaft, Essen, Fed. Rep. of Germany

[21] Appl. No.: 684,002

[22] Filed: Dec. 20, 1984

[30] Foreign Application Priority Data

Feb. 25, 1984 [DE] Fed. Rep. of Germany ..... 3406980

[51] Int. Cl.[4] ..... E21D 9/06; E21D 11/10

[52] U.S. Cl. ..... 405/146; 405/150

[58] Field of Search ..... 405/141, 146, 147, 150

[56] References Cited

U.S. PATENT DOCUMENTS 3,561,223 2/1971 Tabor ..... 405/147 X

FOREIGN PATENT DOCUMENTS 2709713 9/1978 Fed. Rep. of Germany .
2913091 10/1980 Fed. Rep. of Germany ..... 405/146
2932430 2/1981 Fed. Rep. of Germany .
3127311 2/1983 Fed. Rep. of Germany ..... 405/146

*Primary Examiner*—David H. Corbin
*Attorney, Agent, or Firm*—Karl F. Ross; Herbert Dubno

[57] ABSTRACT

A movable wall delimiting a space into which concrete is pumped between a shield lining a tunnel wall and an inner form is advanced by the concrete pressure relative to the shield. This movable wall can be braced by adjustable spring force relative to the shield.

6 Claims, 1 Drawing Figure

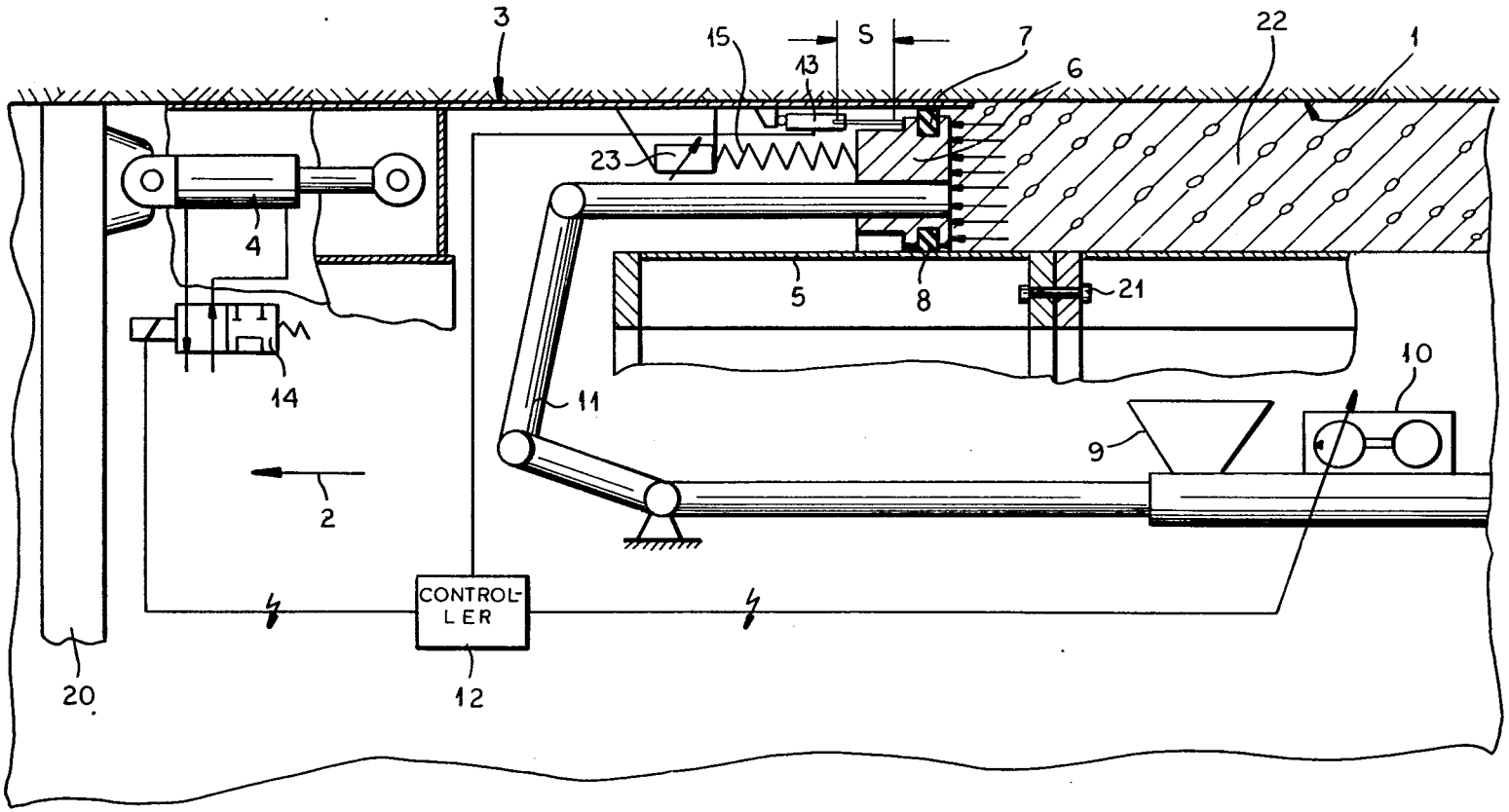
1
22
6
7
S
13
15
23
3
10
21
9
8
5
11
CONTROL-
LER
12
2
14
4
20

METHOD OF AND APPARATUS FOR THE LINING OF A TUNNEL WITH CONCRETE

FIELD OF THE INVENTION

Our present invention relates to a method of emplacing concrete along a tunnel wall and, more particularly, to a method of and to an apparatus for the lining of a tunnel, as it is excavated, with concrete.

BACKGROUND OF THE INVENTION

In the construction of tunnels it is a common practice to provide a tunneling machine which excavates the material ahead of the machine and as its excavating head is driven forwardly by hydraulic or other fluid-operated units braced with respect to the tunnel wall via shields or the like which can form a shell engaging the tunnel wall behind the head.

It is frequently desirable to line the tunnel wall behind the machine with concrete, i.e. to emplace concrete in a pumped form as a lining material along this wall.

While concrete may be sprayed on the wall for this purpose, in many cases the most convenient, economical and desirable technique has been to construct an inner form or casing at a given spacing from the wall of the tunnel and to pump concrete into the resulting space.

At the forward end of this space, a formface can be moved in the direction in which the lining is propagated. This face can be sealed with respect to the inner form or casing and can move with an outer casing which can form part of or be affixed to the shield mentioned previously.

As noted, the shield shell or casing can be connected to the head by piston-and-cylinder arrangements which are articulated to the shield and to the excavating head and which serves to advance the head and to draw the shield toward the head, e.g. in successive or alternating operations. Where the face of the concrete mold constitutes part of this shield, it is drawn forwardly with advance of the concrete and the concrete is pumped behind this shield.

Since the shield is drawn forwardly and the concrete is pumped into the space which results as the shield is drawn forwardly, a constant concrete pressure cannot be maintained at the face of the advancing form. This can result in defects in the concrete lining of the tunnel.

For example, when the strata through which the tunnel is propagated has water pockets or a structure in which water is trapped or which may be permeated by water, any free space which may result from the advance of the shield of the formface as it is drawn forwardly, may result in the drawing of water into the space and the dilution of the concrete or the formation of pockets therein.

In some cases, free water may develop in the space which cannot be expressed by the concrete pumped into the space so that water pockets may remain as defects in the concrete. Consequently, the independent operation of the advance of the formface and the concrete pump almost invariably will lead to defects and in the case in which the tunnel structure has a high water content, may give rise to very significant problems.

To reduce these problems, it has been proposed to measure the pressure of the concrete pumped into the space directly behind the formface and/or in the concrete supply pipe ahead of the formface and to utilize the measured value as a control for the operation of the hydraulic system for advancing the formface and for operating the concrete pump.

When the pressure of the concrete exceeds a limiting value, the concrete supply is throttled. When a lower limit is reached, the hydraulic medium feed to the hydraulic advancing units for the formface is reduced and the advance is slowed.

While this system can to some extent reduce the detrimental effect upon the lining and thus eliminate some of the disadvantages of the earlier systems as described, it has its own disadvantage which is that it is relatively slow to react since control corrections will depend only upon crossing of threshold values. Since the threshold values are spaced apart to define a range of operative concrete pressures, volume differences cannot be avoided within this range.

It has also been found that even with the controls described previously, significant pressure drops in the liquid concrete in the space may result with incursion of loose material from the tunnel wall into the lining.

OBJECTS OF THE INVENTION

It is the principal object of the present invention to provide an improved method of and apparatus for the lining of a tunnel whereby the detrimintal effects on the tunnel lining which result from earlier techniques are largely avoided.

It is also an object of the invention to simplify control of the uniformity of a tunnel lining of concrete.

A further object of this invention is to provide a method of lining a tunnel which is not adversely affected by a long response time of a control system and which also obviates the difficulties encountered when the concrete and formface is emplaced and advanced, respectively, under independent controls or even with synchronization, but where control of the concrete pressure in the space is precluded or insufficient.

Yet another object of this invention is to provide an improved apparatus for the formation of concrete tunnel linings.

SUMMARY OF THE INVENTION

These objects and others which will become apparent hereinafter are attained, in accordance with the invention, in a method of lining a tunnel which comprises excavating a tunnel in a subterranean structure, advancing a shield along the wall of the tunnel as it is excavated, juxtaposing a form with the shield, providing a movable wall between the form and the shield to define the end of a space between the form and the shield, advantageously retaining the wall with a resistant force yieldably against movement in the direction of advance of the tunnel and pumping concrete into the space bounded by the form, the tunnel wall, the shield and the movable wall at a pressure and in a manner such that the pressure of the concrete is pumped into the space applies a force to the movable wall exceeding the resisting forces such that the movable wall is moved solely by the pressure of the concrete corresponding to the force with which the concrete acting on the movable wall exceeds the resisting force.

In its apparatus aspects, the invention comprises the shield, the form, the movable wall and the means for maintaining the resisting force while allowing the movable wall to advance by the excess pressure of the pumped concrete. Consequently, the movement of the movable wall is decoupled from the advance of the shield and can never exceed the progress of the concrete pumping.

With the invention, therefore, the concrete pressure behind the movable wall is maintained in a continuous process with the lining of the tunnel progressing likewise continuously and at substantially constant pressure, the concrete pressure ranging only between the limits required for the full excursion of the movable wall within the range of its elastically yielding brace.

Since the movable wall is propelled solely by the pressure of the concrete pumped into the space, its movement cannot exceed that of the concrete filled behind it. Furthermore, the principal resistance to the movement of the wall may be that of friction between the movable wall and the shield or the form disposed inwardly of the shield. Pressure differences can be minimal and volume fluctuations likewise held to a minimum so that the pressed concrete can be free from inclusions, pockets and water accumulations and is of uniform high quality over the entire tunnel.

According to a feature of the invention, therefore, the movable wall and the shield surrounding it are coupled for limited relative movement, i.e. the movable wall has range of movement relative to the shield between limiting positions of the movable wall in the direction of the advance of the tunnel, the elastic force bracing the movable wall effectively holding the latter as the shield is advanced and the concrete delivered to the space being solely resposnible for the advance of the movable wall.

The compensating force in this case can be adjustable and can be generated by any elastic means. It may be provided with an adjustable force-constant spring, a controlled damping-fluid cylinder or the like. The forces of these means may be additive to the friction force in resisting the displacement of the movable wall.

Such means allow fine control of the advance of the wall in dependence of the geometry and characteristics of the tunnel and the concrete pumping operations to ensure a constant concrete pressure.

BRIEF DESCRIPTION OF THE DRAWING

The above and other objects, features and advantages of the present invention will become more readily apparent from the following description, reference being made to the accompanying drawing in which the sole FIGURE is a diagrammatic vertical section through a tunnel wall lining apparatus associated with an excavating machine.

SPECIFIC DESCRIPTION

In the drawing we have shown diagrammatically at 20 a tunnel excavating head which can be advanced by the operation of hydraulic cylinders 4 articulated to a wall lining shield 3 which can be braced against the tunnel wall formed as the excavating head is advanced. The hydraulic control of the cylinders 4, only one of which is shown although a number of such cylinders can be provided in angularly spaced relationship around the tunnel axis, has been represented at 14.

The operation of such a machine is well known. The shield is braced against the previously formed tunnel wall, e.g. by pressing the shield segments outwardly via radially effective hydraulic jacks, the hydraulic cylinders 4 are energized to advance the excavating head 20, the rotary cutters on the excavating head eat away the subterranean structure and the detritus is carried out on a conveyor running rearwardly through the tunnel and, consequently, the tunnel is advanced in the direction of arrow 2. After the head has progressed to a certain distance, the radial bracing of the shield 3 is relaxed, the cylinders 4 are energized hydraulically in the opposite sense and the shield 3 is drawn in the direction of arrow 2. Thus the shield 3 is connected to the excavating head and forms part of the excavating machine.

An apron of the shield 3, however, forms an outer guide for a movable wall 6 which also rides on the outer surface of an inner form 5 formed from segments which are brought up to the end of the previous form section and bolted in place as represented at 21. The forms 5 are reusable forms which can be detached from an upstream location at which the concrete is hardened.

Between the wall 1 and the form 5 a space 22 is formed which is filled with concrete delivered by a concrete pump 10 and a flexible conduit 11 which can follow the advance of the movable wall 6.

The movable wall 6 is formed as a longitudinally shiftable ring between the shield 3 and the inner form 5. This ring is sealed with respect to the inner surface of the shield 3 by an outer sealing ring 6 and is sealed with respect to the outer surface of the form 5 by an inner sealing ring 8.

Concrete is supplied to the pump through the hopper 9 and is forced into the space 22 through the movable wall 6.

The degree of longitudinal movement of the wall 6 relative to the shield 3 is limited to a distance S which determines that the movable wall should not be liberated from the shield 3 nor excessively driven into the latter. An electrical control system represented at 12 is provided which monitors the piston of a cylinder unit 13 which can form an adjustable damping cylinder and is also a position-monitoring device for the excursion of the wall 6. Based upon the degree of the movement of the wall 6, the system 12 controls both the advance of the shield and the pumping of the concrete so that the shield will always advance sufficiently to enable the concrete pumping to continuously move the wall 6 or, conversely, the concrete feed will be slowed to maintain the concrete pressure in the event the movement of the shield must be reduced for some reason. In addition, a spring arrangement 15 has been illustrated in the drawing and for the sake of illustration only has been shown as a coil spring although a hydraulic, pneumatic, dished-disk (Belleville) or other spring arrangement may be provided. The force constant or characteristic of this spring is adjustable, e.g. through the use of an adjustable seat 23. The spring establishes a minimum resistance of the advance of the coil 6 and thus ensures a minimum concrete pressure in the space 22, the spring cooperating with the friction force in this respect. The wall 6 is advanced, therefore, exclusively by the pressure of the concrete in the space 22.

The control signal for the concrete pump 10 may device from a comparator 12 which receives inputs from the displacement measuring unit 13 and from a sensor responsive to the displacement of the cylinders 4 so that the concrete flow is a function of the actual displacement of the movable wall 6 along the tunnel wall 1.

Furthermore, the limiting positions detected by the displacement measuring unit 13 can, when the movable wall reaches the left hand or forward limiting position, cut off or reduce concrete flow and when the movable wall reaches the right hand or rearward limiting position result in an increase in the pumping of the concrete.

We claim:

1. A method of constructing a tunnel which comprises the steps of:

excavating a tunnel and progressively advancing a shield along a tunnel wall as it is formed in a direction of tunnel advance;

juxtaposing with said shield and inwardly thereof a concrete form having an outer surface defining with said shield and as a portion of said tunnel wall behind said shield a space along said tunnel wall;

bounding said space in said direction by a movable wall disposed between said shield and said form;

pumping concrete into said space to line said tunnel wall with a pressure sufficient to advance said wall at least in part independently of the advance of said shield by the pressure of the concrete supplied to said space;

mounting said movable wall for limited movement in said direction on said shield and controlling the pumping of said concrete and the advance of said shield so that the displacement of said movable wall is effected in a region between limiting positions of said movable wall on said shield solely as a result of the force exerted by the pumped concrete exceeding resistance to movement of said movable wall; and interrupting the supply of concrete to said space upon said movable wall reaching a forward limiting position on said shield and interrupting advance of said shield upon said movable wall reaching a rearward limiting position on said shield.

2. The method defined in claim 1, further comprising the step of increasing the rate of delivery of concrete to said space upon said movable wall reaching a rear limiting position on said shield.

3. The method defined in claim 1, further comprising the step of bracing said movable wall against said shield to yieldably resist the pressure of said concrete in said space with an adjustable spring force, such that said spring force and the friction forces of said movable wall against said shield and said form are less than the forces applied by said concrete to said movable wall.

4. An apparatus for the excavation of a tunnel comprising:

an excavating head having a shield displaceable in a direction of tunnel advance along a tunnel wall formed by said head;

an inner form spaced inwardly of said shield and defining with said tunnel wall a space along said tunnel wall;

means defining a movable wall at least limitedly shiftable in said direction relative to said shield between said shield and said form for bounding said space;

means for pumping concrete into said space whereby the concrete pumped into said space directly advances said movable wall in said direction against resistance to the advance of said movable wall on said is shield;

means on said shield for detecting the displacement of said movable wall relative to said shield for controlling said pump; and means on said shield responsive to the displacement between said movable wall and said shield for controlling the advance of said shield in said direction.

5. The apparatus defined in claim 4, further comprising means on said shield responsive to the displacement of said movable wall for providing a first signal, a fluid cylinder arrangement connected to said shield for displacing same in said direction of advance and providing a sescond control signal, and means for comparing said signals to monitor the actual displacement of said movable wall for controlling the concrete pump.

6. The apparatus defined in claim 4, further comprising adjustable resilient means bracing between said shield and said movable wall for resisting displacement thereof by said concrete.

* * * * *